US010663882B1

(12) United States Patent
Koike

(10) Patent No.: US 10,663,882 B1
(45) Date of Patent: May 26, 2020

(54) IMAGE FORMING APPARATUS AND CONTROL METHOD BY THE SAME WITH TONER QUANTITY MONITORING

(71) Applicant: TOSHIBA TEC KABUSHIKI KAISHA, Shinagawa-ku, Tokyo (JP)

(72) Inventor: Sho Koike, Sunto Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/564,104

(22) Filed: Sep. 9, 2019

(51) Int. Cl.
*G03G 15/08* (2006.01)

(52) U.S. Cl.
CPC ..... *G03G 15/0856* (2013.01)

(58) Field of Classification Search
CPC ..... G03G 15/0849; G03G 15/0853; G03G 15/0856; G03G 15/086
USPC ..... 399/27, 30, 61–63
See application file for complete search history.

(56) References Cited

U.S. PATENT DOCUMENTS 5,826,134 A 10/1998 Hino et al.
8,892,007 B2 * 11/2014 Takane et al. ..... G03G 15/0877 399/27

* cited by examiner

*Primary Examiner* — William J Royer
(74) *Attorney, Agent, or Firm* — Amin, Turocy & Watson LLP

(57) ABSTRACT

An image forming apparatus includes a developing device that forms a toner image on a sheet; a supply device provided with a cartridge for accommodating toner and supplying the toner in the cartridge to the developing device; a sensor that acquires a physical quantity relating to an amount of toner in the developing device; a timer that counts time; and a controller that drives the supply device until a condition that the acquired physical quantity indicates that the amount of toner is equal to or greater than a predetermined value is satisfied when a condition that the physical quantity indicates that the amount of toner becomes small is satisfied, counts time during which the supply device is being driven with the timer, and determines that the amount of toner in the cartridge becomes smaller than a predetermined amount if the counted time is longer than a predetermined threshold value.

20 Claims, 4 Drawing Sheets

IMAGE FORMING APPARATUS AND CONTROL METHOD BY THE SAME WITH TONER QUANTITY MONITORING

FIELD

Embodiments described herein relate generally to an image forming apparatus and a control method by the same.

BACKGROUND

In an image forming apparatus, a near empty state indicating that a toner will run out in a short time is displayed before a display indicating that the toner is empty is made. A user can order a new toner at a timing at which the near empty state is displayed. By displaying the near empty state as described above, the image forming apparatus can be used continuously without occurrence of shortage of the toner.

As a conventional method for determining the near empty state, a method using a sub hopper is known. The sub hopper is a container provided between a developing device and a toner cartridge. The sub hopper is provided with a sensor for detecting an amount of toner. If the amount of toner does not reach a threshold value, it can be determined that the toner cartridge is in a near empty state. For example, in such a state, it is determined that the image forming apparatus is in the near empty state.

However, in the method using the sub hopper, it is necessary to provide the sub hopper. In the sub hopper, it is also necessary to provide a toner sensor only used for determining the near empty state. Therefore, there is a problem that the cost increases in the method using such a sub hopper.

DETAILED DESCRIPTION

In accordance with an embodiment, an image forming apparatus comprises a developing device configured to form a toner image on a sheet; a supply device provided with a cartridge for accommodating toner and configured to supply the toner in the cartridge to the developing device; a sensor configured to acquire a physical quantity relating to an amount of toner in the developing device; a timer configured to count a time; and a controller configured to drive the supply device until a condition that the physical quantity acquired by the sensor indicates that the amount of toner is equal to or greater than a predetermined value is satisfied when a condition that the physical quantity indicates that the amount of toner becomes small is satisfied, count a time during which the supply device is being driven with the timer, and determine that the amount of toner in the cartridge becomes smaller than a predetermined amount if the time counted by the timer is longer than a predetermined threshold value.

Figure 1:
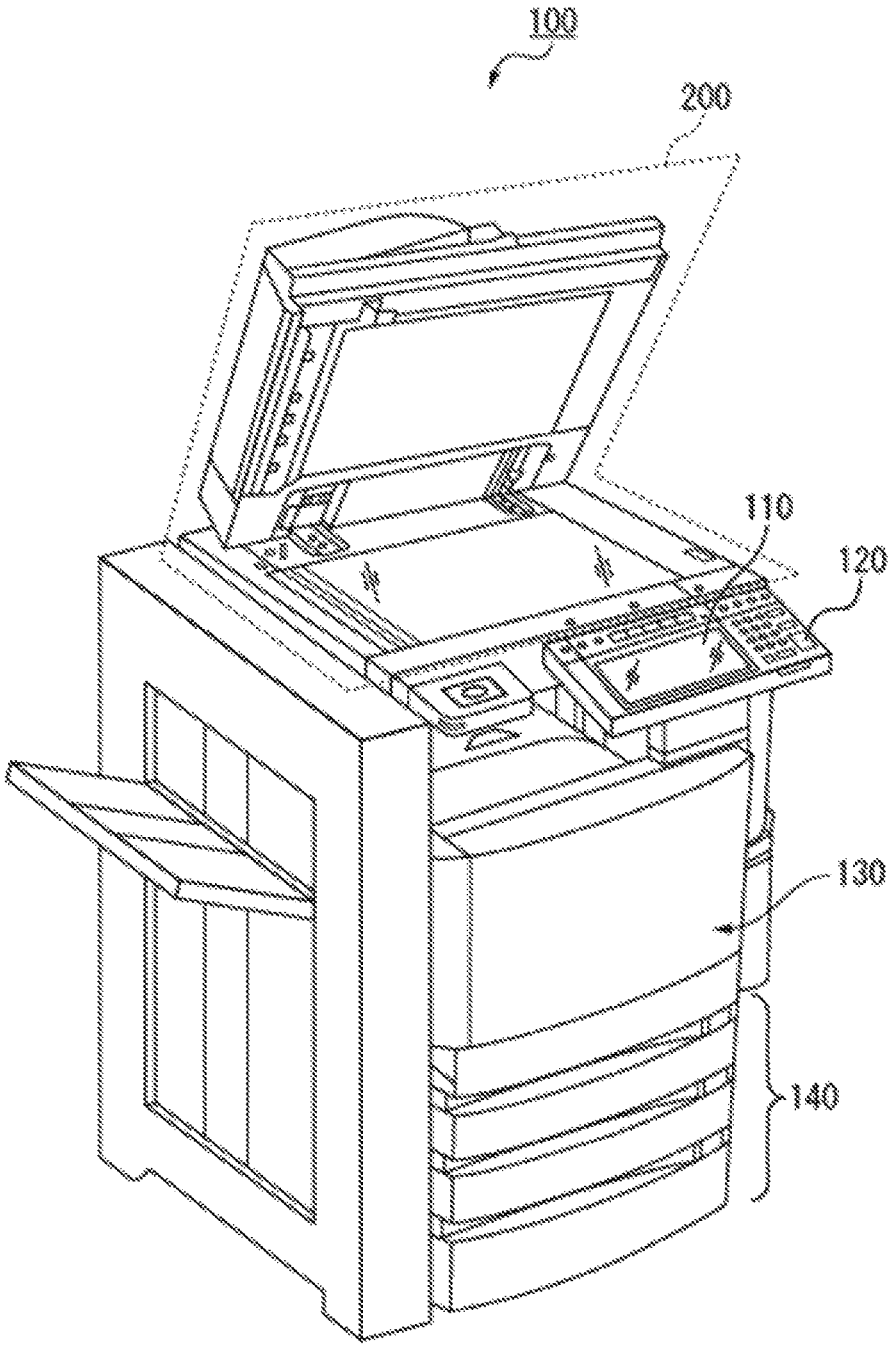
FIG. 1 is an external view illustrating an overall configuration of an image forming apparatus according to an embodiment.

FIG. 1 is an external view illustrating an overall configuration of an image forming apparatus 100 according to the embodiment. The image forming apparatus 100 is, for example, a multi-function peripheral. The image forming apparatus 100 includes a display 110, a control panel 120, an image forming unit 130, a sheet housing section 140 and an image reading section 200. A toner cartridge is mounted in the image forming apparatus 100. The toner cartridge may be filled with a decolorable toner that can be decolored afterwards, or may be filled with a toner that cannot be decolored afterwards.

The image forming apparatus 100 forms an image on a sheet using a toner. The sheet is, for example, a paper or a label paper. Any type of sheet can be used as long as the image forming apparatus 100 can form an image on the surface of the sheet.

The display 110 is an image display device such as a liquid crystal display, an organic EL (Electro Luminescence) display and the like. The display 110 displays various kinds of information relating to the image forming apparatus 100.

The control panel 120 includes a plurality of buttons. The control panel 120 receives an operation from a user. The control panel 120 outputs a signal corresponding to the operation performed by the user to a controller 160 (See FIG. 4) of the image forming apparatus 100. The display 110 and the control panel 120 may be integrated with each other to form a touch panel.

The image forming unit 130 forms an image on the sheet based on image information generated by the image reading section 200 or image information received through a communication line. The image forming unit 130 forms an image through the following processing, for example. The image forming unit 130 forms an electrostatic latent image on a photoconductive drum based on the image information. The image forming unit 130 forms a visible image by attaching the toner to the electrostatic latent image. The toner may be a decolorable toner, a non-decolorable toner (general toner), a decorative toner, or the like. The toner may be a toner of which a color is faded (erased) when heated.

The image forming unit 130 transfers the visible image onto the sheet. The image forming unit 130 fixes the visible image on the sheet by heating and pressurizing the sheet. The sheet on which the image is formed may be a sheet accommodated in the sheet housing section 140, or a sheet that is manually fed.

The image reading section 200 reads the image information of a reading object as intensity of light. The image reading section 200 records the read image information. The recorded image information may be transmitted to another information processing apparatus via a network. The recorded image information may be used for forming an image on the sheet by the image forming unit 130.

Figure 2:
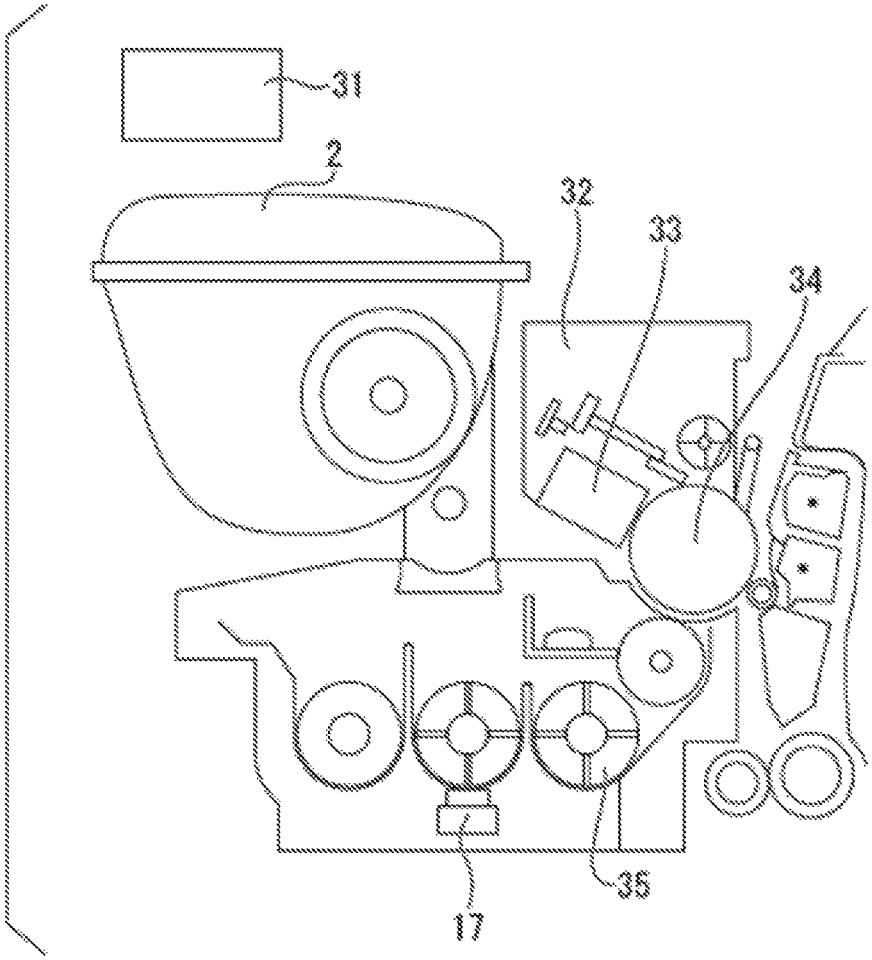
FIG. 2 is a diagram illustrating a configuration of a part of an image forming unit.

FIG. 2 a diagram illustrating a configuration of a part of the image forming unit 130. The image forming unit 130 includes a cartridge (toner cartridge) 2, a sensor 17, a toner replenishment motor (supply device) 31, a cleaning unit 32, an electrostatic charger 33, a photoconductor 34 and a developing device 35.

The sensor 17 outputs a physical quantity (first physical quantity) relating to an amount of toner remaining in the developing device 35 of the image forming apparatus 100. In the following description, the first physical quantity becomes large as the amount of toner remaining in the developing device 35 is large. The sensor 17 may be, for example, an automatic toner sensor. In this case, the sensor 17 may detect density of the toner. The sensor 17 may detect a remaining amount of toner. The sensor 17 may be, for example, a sensor for measuring permeability.

The cartridge 2 is detachable against the image forming apparatus 100. The cartridge 2 is filled with the toner. The toner replenishment motor 31 operates at the time the toner in the cartridge 2 is replenished to the developing device 35. The cleaning unit 32 removes the toner attached to a surface of the photoconductor 34. The electrostatic charger 33 charges the surface of the photoconductor 34. On a surface of the photoconductor 34, a toner image is formed. The developing device 35 can store the toner. The developing device 35 supplies the toner to the photoconductor 34 through a developing roller. A predetermined amount of magnetic material (carrier) is present in the developing device 35. By stirring the toner and the magnetic material, charge is generated in the toner. The amount of magnetic material present in the developing device 35 is substantially constant. Therefore, when the amount of toner in the developing device 35 is large, the amount of magnetic material is relatively small. On the other hand, when the amount of toner in the developing device 35 is small, the amount of magnetic material is relatively large. As described above, the physical quantity such as the permeability changes in accordance with the amount of toner in the developing device 35. The sensor 17 detects the amount of toner in the developing device 35 based on the physical quantity that changes as described above.

If the toner replenishment motor 31 is driven, the toner in the cartridge 2 is moved to the developing device 35. The toner moved to the developing device 35 adheres to the electrostatic latent image on the photoconductor 34 at the time of image formation. A visible image is formed by the adhesion of the toner. When the toner in the developing device 35 is used in the image formation, the amount of toner in the developing device 35 gradually decreases. The amount of toner in the developing device 35 is detected based on the output from the sensor 17. If it is determined that the amount of toner in the developing device 35 is smaller than a lower limit threshold value, the toner replenishment motor 31 is driven until the amount of toner is equal to or greater than an upper limit threshold value. By driving the toner replenishment motor 31, the toner in the cartridge 2 is moved to the inside of the developing device 35. The time required for the amount of toner in the developing device 35 to be a value equal to or greater than the upper limit threshold value from a value smaller than the lower limit threshold value (hereinafter, referred to as "replenishment time") changes according to the amount of toner in the cartridge 2.

Figure 3:
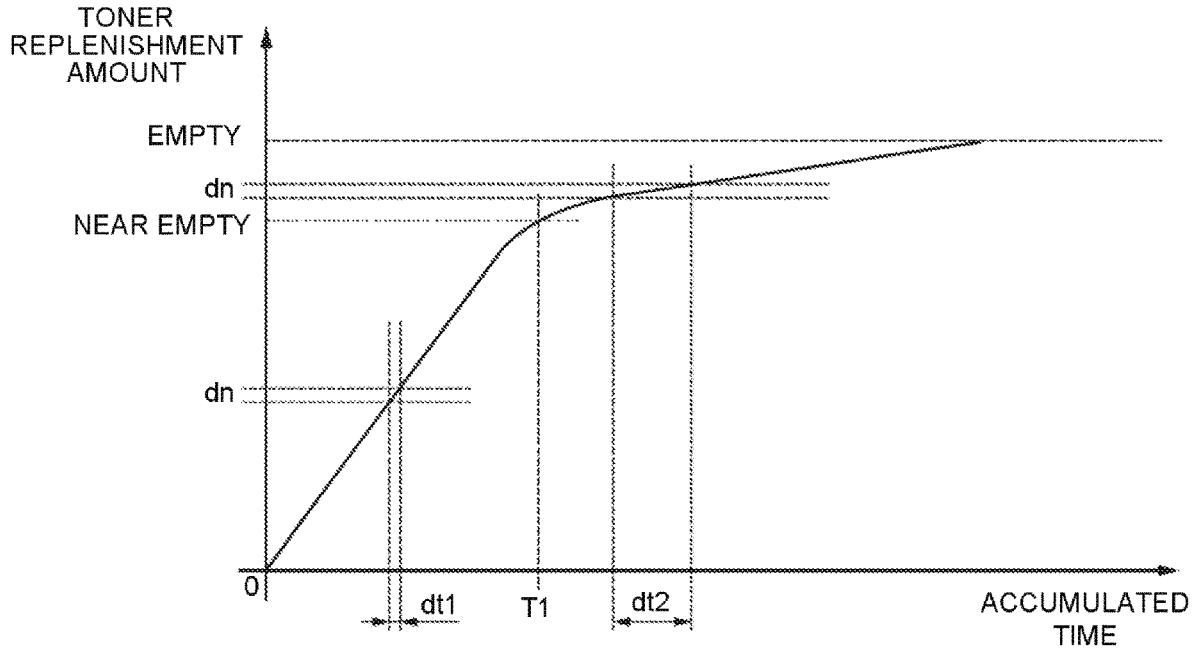
FIG. 3 is a graph illustrating the change in a replenishment time.

FIG. 3 is a graph illustrating the change in the replenishment time. A vertical axis represents an accumulated amount of toner replenished to the developing device 35 from the cartridge 2 in a full state. A horizontal axis represents an accumulated value of the time (replenishment time) required to replenish the toner from the cartridge 2 to the developing device 35. In FIG. 3, do indicates an amount of toner replenished from the cartridge 2 to the developing device 35 through one replenishment operation. In FIG. 3, inclination of the graph changes greatly before and after the accumulated time represented by the horizontal axis reaches T1. When the accumulated time is longer than T1, the inclination of the graph decreases radically. The time required to replenish the toner by the amount of dn at a timing before T1 is dt1. On the other hand, the time required to replenish the toner by the amount of dn at a timing after T1 is dt2. As can be clearly seen from the graph in FIG. 3, dt2 is larger than dt1. A point (e.g., T1) at which the time required to replenish the toner by a predetermined amount (e.g., dn) changes is substantially equal to a timing at which the near empty state is determined in the prior art. In the present embodiment, the near empty state is determined based on the timing at which the replenishment time changes as described above. Specifically, a threshold value of the replenishment time may be determined based on a replenishment time required in a state in which the cartridge 2 is sufficiently filled with the toner and a replenishment time required in a state in which the amount of toner in the cartridge 2 becomes an amount at which the near empty state is determined.

Figure 4:
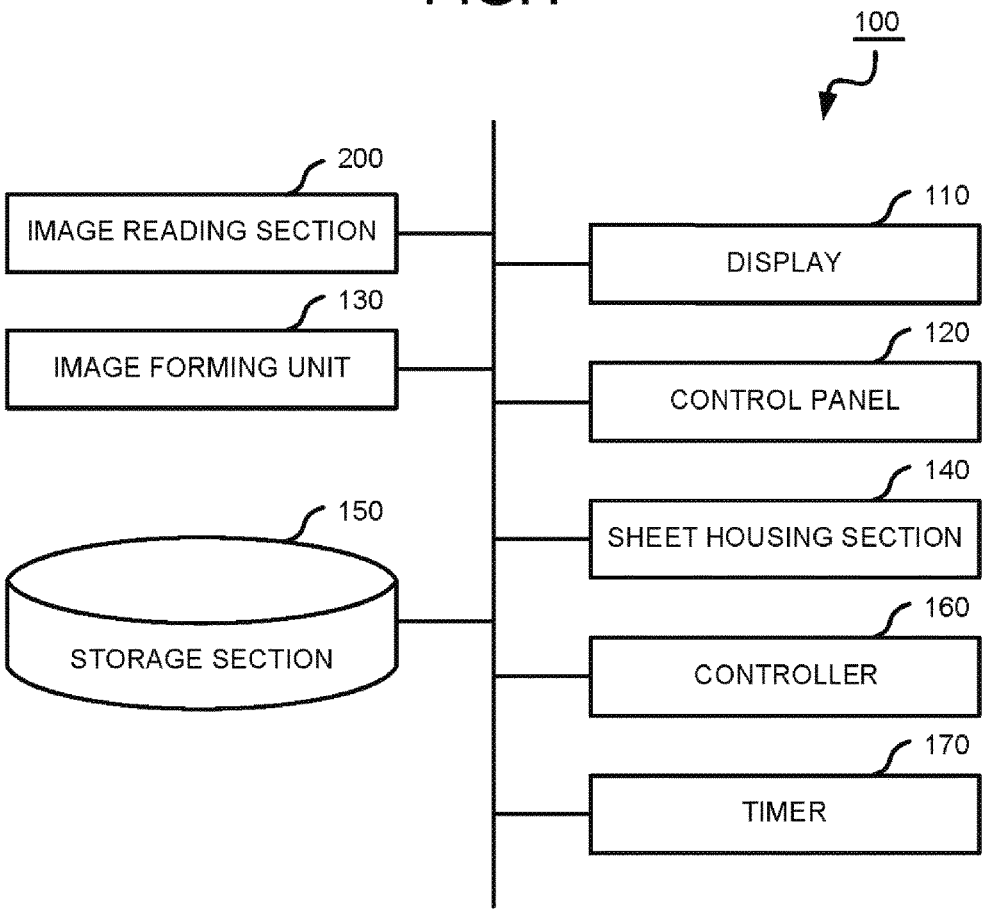
FIG. 4 is a block diagram illustrating hardware structure of the image forming apparatus according to the embodiment.

FIG. 4 is a block diagram illustrating hardware structure of the image forming apparatus 100 according to the embodiment. The image forming apparatus 100 includes the image reading section 200, the display 110, the control panel 120, the image forming unit 130, the sheet housing section 140, a storage section 150, the controller 160, and a timer 170. Since the image reading section 200, the display 110, the control panel 120, the image forming unit 130 and the sheet housing section 140 are already described among the hardware, the description thereof is omitted.

The storage section 150 is a magnetic hard disk device, a semiconductor storage device or the like. The storage section 150 stores data required at the time the image forming apparatus 100 operates. For example, the storage section 150 may store data of a program to be executed by the controller 160. The storage section 150 may temporarily store image data formed in the image forming apparatus 100. The storage section 150 may store image data generated by the image reading section 200. The storage section 150 may store data indicating a threshold value used for determining the near empty state as described above. The storage section 150 may store data indicating the lower limit threshold value and the upper limit threshold value used at the time the toner replenishment motor 31 is driven.

The controller 160 is configured by a processor such as a CPU (Central Processing Unit) and a memory. The controller 160 reads a program stored in the storage section 150 in advance to execute it. The controller 160 controls the operation of each device of the image forming apparatus 100. The controller 160 controls the driving of the toner replenishment motor 31 based on the physical quantity output from the sensor 17. The controller 160 determines whether or not the image forming apparatus 100 is in the near empty state based on a driving time of the toner replenishment motor 31. If the near empty state is determined, the controller 160 performs a predetermined operation. If the near empty state is determined, the controller 160 controls the display 110 to display an image indicating the near empty state, for example. The image indicating the near empty state may be, for example, an image indicating the near empty state or an image for instructing to prepare a toner cartridge. The timer 170 counts the time under the control of the controller 160. The timer 170 counts the time required for an operation of replenishing the toner from the cartridge 2 to the developing device 35 once under the control of the controller 160.

Figure 5:
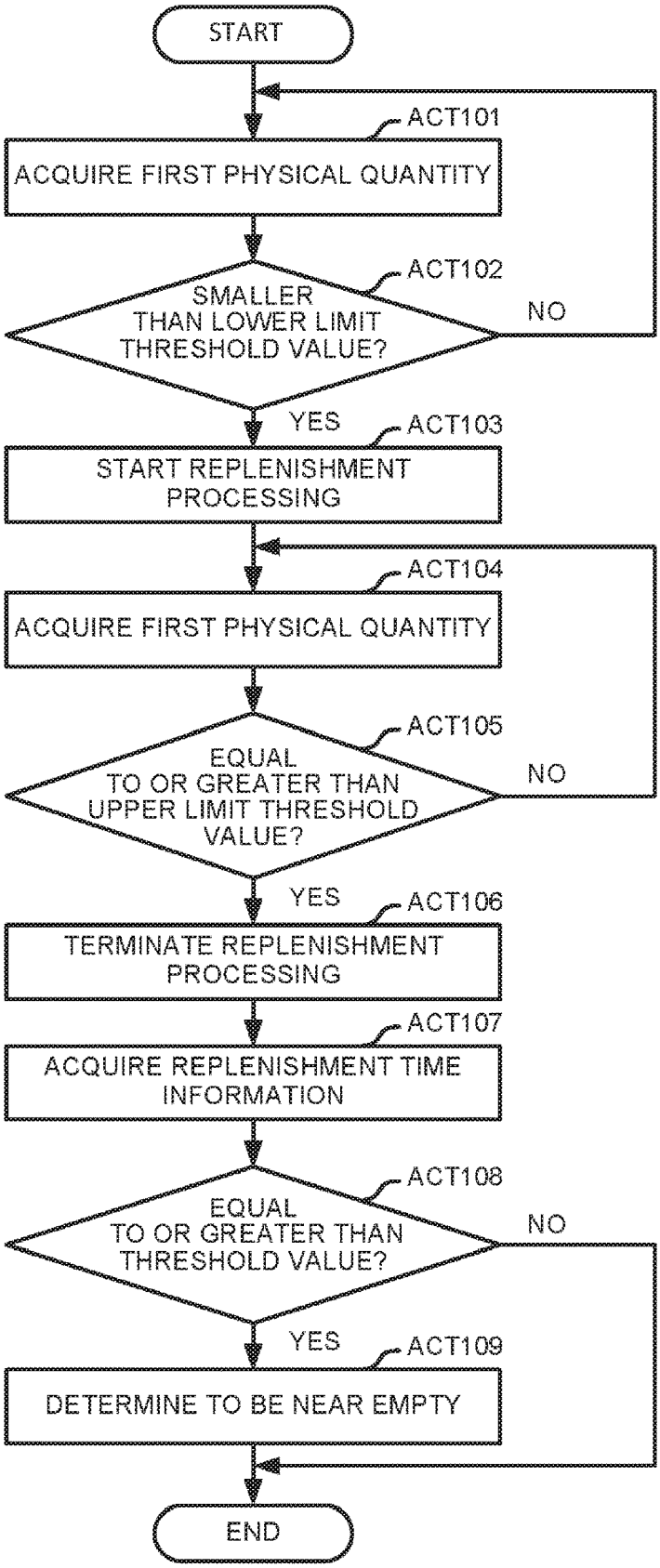
FIG. 5 is flowchart depicting a specific example of an operation performed by a controller.

FIG. 5 is flowchart depicting a specific example of an operation performed by the controller 160. The controller 160 acquires the first physical quantity at a predetermined timing (Act 101). If the first physical quantity is equal to or greater than the lower limit threshold value (No in Act 102), the controller 160 returns to the processing in Act 101 without executing any other processing. On the other hand, if the first physical quantity is smaller than the lower limit threshold value (Yes in Act 102), the controller 160 starts a replenishment processing (Act 103). At the time of starting the replenishment processing, the controller 160 starts driving the toner replenishment motor 31. The controller 160 starts counting the time with the timer 170.

Thereafter, the controller 160 acquires the first physical quantity at a predetermined timing (Act 104). If the first physical quantity is smaller than the upper limit threshold value (No in Act 105), the controller 160 returns to the processing in Act 104 without executing any other processing. On the other hand, if the first physical quantity is equal to or greater than the upper limit threshold value (Yes in Act 105), the controller 160 terminates the replenishment processing (Act 106). At the time of terminating the replenishment processing, the controller 160 stops driving the toner replenishment motor 31, and stops counting the time with the timer 170. The controller 160 acquires replenishment time information based on the counting of the time by the timer 170 (Act 107). The replenishment time information indicates the replenishment time. The replenishment time information may be a value indicating the time, or may be a value of another dimension indicating a length of time or a dimensionless value.

The controller 160 determines whether or not the value indicated by the replenishment time information is equal to or greater than a threshold value (Act 108). The threshold value to be compared with the replenishment time information may be, for example, predetermined based on the replenishment time obtained at a timing such as T1 in the graph shown in FIG. 3. The threshold value may be determined by performing a predetermined arithmetic operation on the replenishment time obtained when the cartridge 2 in the full state is mounted and the replenishment processing is performed. The predetermined arithmetic operation may be, for example, an arithmetic operation of multiplying a predetermined number (e.g., 1.5).

If the value indicated by the replenishment time information is smaller than the threshold value (No in Act 108), the controller 160 terminates the processing without performing determination on the near empty state. On the other hand, if the value indicated by the replenishment time information is equal to or greater than the threshold value (Yes in Act 108), the controller 160 determines that the image forming apparatus 100 is in the near empty state (Act 109).

In the image forming apparatus 100 configured as described above, the near empty state is determined using the sensor 17 that is generally mounted in the image forming apparatus 100 (Act 109). Specifically, the near empty state is determined based on the length of replenishment time using the sensor 17 used when the toner is replenished from the cartridge 2 to the developing device 35. Therefore, it is not necessary to newly provide a sensor or a container (e.g., a sub hopper) only for determination on the near empty state, and thus the increase in cost can be suppressed.

In the present embodiment, a screw provided in the cartridge 2 may be a larger screw. According to such a configuration, the near empty state can be determined at an earlier timing. Specifically, a size of the screw in the cartridge 2 may be determined based on a remaining amount of toner at which it is expected that the near empty state is determined. If it is expected that the near empty is determined at an earlier timing, a larger screw is provided. In this case, the threshold value to be compared with the replenishment time is a smaller value. If it is expected that the near empty is determined at a later timing, a smaller screw is provided. In this case, the threshold value to be compared with the replenishment time is a larger value.

(Modification)

In the embodiment described above, a warning is output by performing a display on the display 110, but it is not necessarily limited to the display on the display 110. For example, a sound indicating the warning may be output from a speaker, or the warning may be output at a communication terminal device connected to the image forming apparatus 100 in a communication enabled manner.

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. An image forming apparatus, comprising:

a developing device configured to form a toner image on a sheet;

a supply device comprising a cartridge that accommodates toner and configured to supply the toner in the cartridge to the developing device;

a sensor configured to acquire a physical quantity relating to an amount of toner in the developing device;

a timer configured to count a time; and a controller configured to drive the supply device until a condition that the physical quantity acquired by the sensor indicates that the amount of toner is equal to or greater than a predetermined value is satisfied when a condition that the physical quantity indicates that the amount of toner becomes small is satisfied, count a time during which the supply device is being driven with the timer, and determine that the amount of toner in the cartridge becomes smaller than a predetermined amount if the time counted by the timer is longer than a predetermined threshold value.

2. The image forming apparatus according to claim 1, wherein the controller is configured to perform a predetermined operation if it is determined that the amount of toner in the cartridge becomes smaller than a predetermined amount.

3. The image forming apparatus according to claim 1, wherein the sensor is configured to acquire a physical quantity relating to density of the toner in the developing device.

4. The image forming apparatus according to claim 1, wherein the predetermined threshold value to be compared with the time is determined based on a time required to supply a predetermined amount of toner to the developing device in a state in which the cartridge is sufficiently filled with the toner and a time required to supply a predetermined amount of toner to the developing device in a state in which the amount of toner in the cartridge is decreased to about the predetermined amount.

5. The image forming apparatus according to claim 1, wherein the predetermined threshold value to be compared with the time is determined based on a size of a screw provided in the cartridge.

6. The image forming apparatus according to claim 1, wherein the predetermined threshold value is equal to replenishment time.

7. The image forming apparatus according to claim 1, wherein the sensor detects permeability changes corresponding to changes in the amount of toner.

8. A method performed by an image forming apparatus, a sensor, comprising:

driving a supply device comprising a cartridge that accommodates toner and configured to supply the toner in the cartridge to a developing device until a condition that a physical quantity acquired by a sensor configured to acquire a physical quantity relating to an amount of toner in the developing device indicates that the amount of toner is equal to or greater than a predetermined value is satisfied when a condition that the physical quantity indicates that the amount of toner becomes small is satisfied;

counting a time during which the supply device is being driven with a timer; and determining that the amount of toner in the cartridge becomes smaller than a predetermined amount if the time counted by the timer is longer than a predetermined threshold value.

9. The method according to claim 8, further comprising:

performing a predetermined operation if it is determined that the amount of toner in the cartridge becomes smaller than a predetermined amount.

10. The method according to claim 8, further comprising:

acquiring a physical quantity relating to density of the toner in the developing device.

11. The method according to claim 8, further comprising:

determining the predetermined threshold value to be compared with the time based on a time required to supply a predetermined amount of toner to the developing device in a state in which the cartridge is sufficiently filled with the toner and a time required to supply a predetermined amount of toner to the developing device in a state in which the amount of toner in the cartridge is decreased to about the predetermined amount.

12. The method according to claim 8, further comprising:

determining the predetermined threshold value to be compared with the time based on a size of a screw provided in the cartridge.

13. The method according to claim 8, further comprising:

detecting permeability changes corresponding to changes in the amount of toner.

14. A toner processing device, comprising:

a supply device comprising a cartridge that accommodates toner and configured to supply the toner in the cartridge to a developing device;

a sensor configured to acquire a physical quantity relating to an amount of toner in the developing device;

a timer configured to count a time; and a controller configured to drive the supply device until a condition that the physical quantity acquired by the sensor indicates that the amount of toner is equal to or greater than a predetermined value is satisfied when a condition that the physical quantity indicates that the amount of toner becomes small is satisfied, count a time during which the supply device is being driven with the timer, and determine that the amount of toner in the cartridge becomes smaller than a predetermined amount if the time counted by the timer is longer than a predetermined threshold value.

15. The toner processing device according to claim 14, wherein the controller is configured to perform a predetermined operation if it is determined that the amount of toner in the cartridge becomes smaller than a predetermined amount.

16. The toner processing device according to claim 14, wherein the sensor is configured to acquire a physical quantity relating to density of the toner in the developing device.

17. The toner processing device according to claim 14, wherein the predetermined threshold value to be compared with the time is determined based on a time required to supply a predetermined amount of toner to the developing device in a state in which the cartridge is sufficiently filled with the toner and a time required to supply a predetermined amount of toner to the developing device in a state in which the amount of toner in the cartridge is decreased to about the predetermined amount.

18. The toner processing device according to claim 14, wherein the predetermined threshold value to be compared with the time is determined based on a size of a screw provided in the cartridge.

19. The toner processing device according to claim 14, wherein the predetermined threshold value is equal to replenishment time.

20. The toner processing device according to claim 14, wherein the sensor detects permeability changes corresponding to changes in the amount of toner.

* * * * *